United States Patent [19]

Nagao et al.

[11] 3,935,924

[45] Feb. 3, 1976

[54] VIBRATORY MATERIAL OF PAPER PULP AND CARBON FIBERS

[75] Inventors: Shozo Nagao; Naoyuki Mitani; Michinobu Ikuta; Kenji Fujisawa, all of Otsu, Japan

[73] Assignee: Toray Industries, Inc., Tokyo, Japan

[22] Filed: Dec. 20, 1973

[21] Appl. No.: 426,574

[52] U.S. Cl. ..... 181/169; 162/141

[51] Int. Cl.² ..... G10K 13/00; H04R 7/00

[58] Field of Search ..... 181/169, 167, 170; 162/141, 146; 252/510, 511

[56] References Cited

UNITED STATES PATENTS

| | | | |
|---|---|---|---|
| 1,759,387 | 5/1930 | Bateholts | 181/170 |
| 3,406,126 | 10/1968 | Litant | 252/511 |
| 3,717,218 | 2/1973 | Shiga et al. | 181/167 |
| 3,730,830 | 5/1973 | Driscoll | 162/146 |

FOREIGN PATENTS OR APPLICATIONS

| | | | |
|---|---|---|---|
| 1,110,791 | 4/1968 | United Kingdom | 181/167 |

*Primary Examiner*—Stephen J. Tomsky

[57] ABSTRACT

A vibratory plate of pulp and chopped carbon fibers mixed uniformly in the paper. The pulp is thoroughly beaten to a degree not higher than 300 cc. of Canadian standard freeness.

14 Claims, 10 Drawing Figures

INTERNAL LOSS ( tan δ )
0.05
0.01
700
100
FREENESS (C.C.)

YOUNG'S MODULUS ( kg/mm² )
300
100
700
100
FREENESS (C.C.)

YOUNG'S MODULUS (kg/mm²)
500
100
700
300
100
FREENESS (C.C.)

√φ/m
X 10⁵ cm/SEC.
4.0
3.0
2.0
0
50
CARBON FIBER CONTENT (wt %)

VIBRATORY MATERIAL OF PAPER PULP AND CARBON FIBERS

BACKGROUND OF THE INVENTION

The present invention relates to a vibratory plate used for an audio-electrical instrument.

It has heretofore been very difficult to regenerate evenly, with one speaker only, sound having a scope extending from low frequencies of 30 – 50 Hz to high frequencies of 15000 – 20000 Hz or more. Yet such a frequency range is generally said to be necessary for high fidelity loud speakers.

Heretofore, so-called double cone-type loud speakers have been used for that purpose. These have combined a small diameter cone for high frequency sound reproduction with a large diameter cone for low frequency sound reproduction. Alternatively, a plurality of separate speakers consisting of a large diameter speaker for low frequencies and a small diameter speaker for high frequencies has been adopted. However, mutual interference often takes place in a connecting portion between the low frequency zone and the high frequency zone, causing large and small waves in the frequency characteristics. When a network is used for dividing frequencies, satisfactory damping of low frequencies cannot be obtained. When independent amplifiers are used for low and for high frequencies, the cost of the equipment rises substantially. Accordingly, there are many problems in use, design and manufacture.

An object of the present invention is to provide a vibratory plate which is capable of regenerating evenly a broad scope of frequency from low to high without using a plurality of vibratory plates.

Another object of the present invention is to provide a vibratory plate for an audio electrical instrument having a large $\sqrt{E/\rho}$ and a proper value of internal loss which is one of the most important characteristics of vibratory plates.

Still another object of the present invention is to provide a vibratory plate for an audio-electrical instrument without creating large and small waves having frequency characteristics considered to be due to resonance, and which has excellent capability in separating sounds.

Still another object of the present invention is to provide a vibratory plate for an audio-electrical instrument which is unlikely to be subjected to strain at the time of its formation.

Other objects of the present invention will become apparent from the following description.

The present invention provides a vibratory plate for an audio-electrical instrument comprising paper made of pulp having a maximum beating degree of 300 cc of freeness when measured by the Canadian standard freeness test, and chopped carbon fibers having a Young's modulus of at least about 8000 kg/mm$^2$, said pulp and (chopped) carbon fibers being mixed evenly with each other.

The term "freeness" in this specification means Canadian standard freeness, measured by the method referred to as "Tappi Standard" T-227m-58, as designated by TAPPI (Technical Association of the Pulp and Paper Industry) of the United States of America.

DETAILED DESCRIPTION OF THE INVENTION

Figure 1:
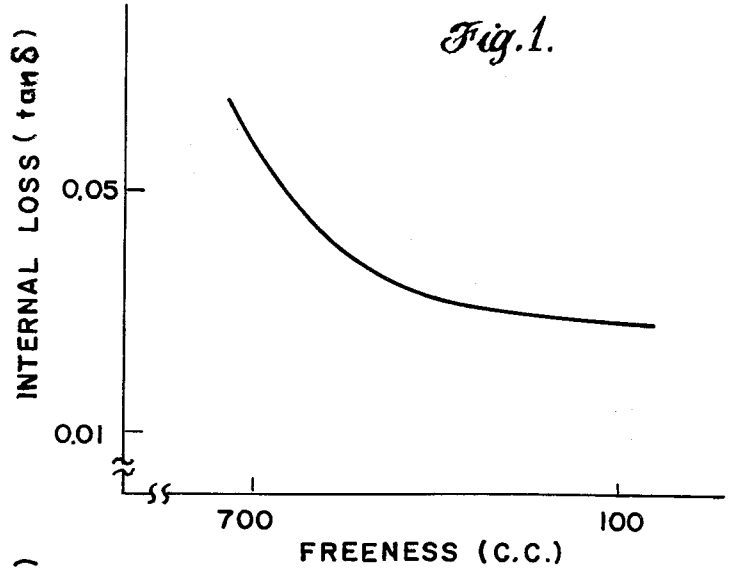
FIG. 1 is a graph showing the relationship between the degree of beating (freeness) of pulp and the internal loss or loss tangent (tan $\delta$) of paper made from this pulp.

The resonance frequency fh of high frequency sound, expressing the regenerating limit of a high sound, may be expressed by the following equation:

$$fh = \cos\theta/2\pi a \sqrt{E/\rho}\sqrt{1 + mc/mv},$$

where $\theta$ is one-half of the vertical angle of the cone, $a$ is its radius, E is its Young's Modulus, mc is its mass, and mv is the mass of the voice coil.

Specifically, when the shape, mass and radius of the cone and the mass of the voice coil are constant, the resonance frequency of a high frequency sound fh is proportional to the $\sqrt{E/\rho}$ of the cone. The $\sqrt{E/\rho}$ shows the speed of propagation of a sound in the cone material. However, in a conventional cone, the magnitude of $\sqrt{E/\rho}$ has a limit.

Regarding the material for conventional conic vibratory plates, fibrous materials and foam-containing resins have been used mainly, especially fibrous materials. Natural fibers such as cotton, silk, bamboo fiber, wooden pulp and paper pulp; inorganic fibers such as glass fibers and metal fibers; synthetic fibers such as polyvinyl alcohol, polyacryl and polyester fibers, and artificial fibers such as rayon are used.

Vibratory plates are usually produced by floating the fibers alone or as a mixture of fibers, on water or a proper medium, taking it up on a net mold to make a sheet, and drying the sheet.

The value of $\sqrt{E/\rho}$ of a vibratory plate made of known materials is about 2000 – 2500 m/sec. Accordingly, insofar as a conventional vibratory plate is used, it is almost impossible to reproduce evenly a high frequency sound zone in the vicinity of 15000 Hz with a speaker having a diameter of, for instance, at least 25 cm.

In the present invention, the vibratory plate uses materials containing carbon fibers having a high Young's modulus of at least 8000 kg/mm². These carbon fibers are made from precusor fibers such as cellulose, polyacrylonitrile, pitch and lignin. Known methods of fabrication are described in detail in U.S. Pat. Nos. 3,107,152 (cellulose), 3,285,696 and 3,412,062 (polyacrylonitrile), 3,565,980 (pitch) and 3,461,082 (lignin). These carbon fibers are different from carbon powder or coal but are similar in some ways to cotton, silk, nylon, etc. Accordingly, the $\sqrt{E/\rho}$ of the material per se is high, making it possible to provide a large $\sqrt{E/\rho}$ for the vibratory plate. However, even if the $\sqrt{E/\rho}$ of the fiber material per se is high, when it is formed into a vibratory plate, the $\sqrt{E/\rho}$ of the vibratory plate does not necessarily become large. In order to obtain a vibratory plate having a large $\sqrt{E/\rho}$ by using a fiber material having a large $\sqrt{E/\rho}$ the adhesion among the fiber materials must be good. This can be done by adding a synthetic or natural binder such as synthetic resin, synthetic rubber, synthetic fiber, glue or rosin. However, even if these conventional methods are applied to carbon fibers having a high Young's modulus it is not possible to provide a proper value of internal loss which is one of the most important characteristics as a vibratory plate, although there is an increase of the $\sqrt{E/\rho}$ as a vibratory plate. Accordingly, the unusual peaks and dips in the frequency characteristics considered to be due to the phenomenon of resonance are brought about. As a result, separation and sharpness of sound are poor. This is a fatal defect in a vibratory plate.

The present invention eliminates this drawback by combining carbon fibers with pulp. Carbon fibers having a Young's modulus of at least 8000 kg/mm² are effective for increasing the resonance frequency of the high frequency sound fh of a vibratory plate. When the Young's modulus of the carbon fibers is 15000 kg/mm², the plate is more effective. Carbon fibers having a filament diameter of 1 – 20 $\mu$ are preferred, and it is further preferable to provide a fine roughened surface which is formed by oxidation of the fiber surface, for improving adhesion. When the carbon fibers to be mixed are too short, the effect of improving the $\sqrt{E/\rho}$ is small. On the other hand, if the fibers are too long, the miscibility and dispersion at the time of making paper are poor. Because of that, a fiber length range of about 0.5 – 20 mm is preferred.

Fine beating of pulp for manufacturing a vibratory plate, has been done before. It causes an internal fibrillation of pulp fibers, which means a loosening of the fine structure of the fibers. As a result, the fiber contains water and swells. Mechanical treatment also causes external fibrillation of pulp fibers, which means napping or branching of fibrils appearing on the surface of the fibers, formation of fine fibers when the fiber film of the outer layer disconnects from the fiber and fibrils, and shortening of fibers by cutting them in the direction of their length. By varying the degree of beating, it is possible to change the physical characteristics of the resulting paper. There is a close relationship among the degree of beating of pulp, the Young's modulus, the density and the internal loss of a vibratory plate.

FIG. 1 shows this relationship. As shown in FIG. 1 the internal loss (tan $\delta$) decreases when the degree of beating of the pulp is increased. As mentioned above, the degree of beating has an effect upon the freeness of the pulp. When the degree of beating is high, freeness decreases.

Figure 2:
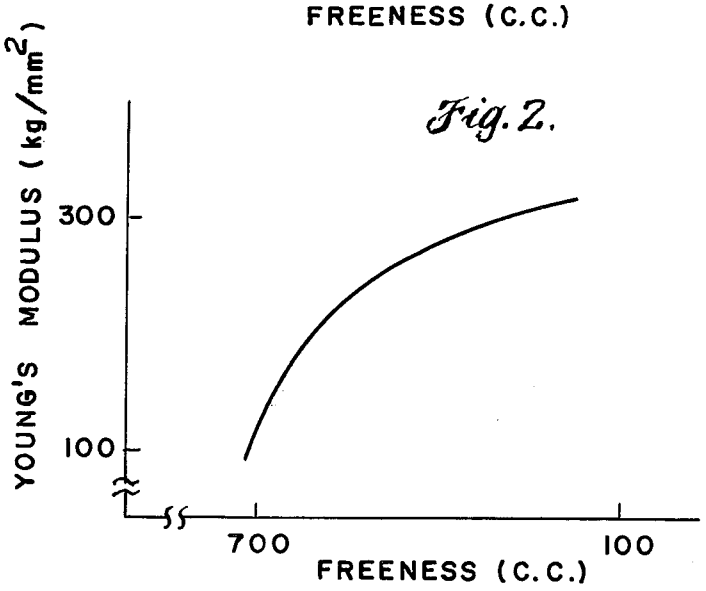
FIG. 2 is a graph showing the relationship between the degree of beating (freeness) of pulp and the Young's modulus of paper made from the pulp.

And as shown in FIG. 2, when the beating degree of the pulp is increased, both the Young's modulus E and the density $\rho$ of the vibratory plate increase. Accordingly, upon manufacturing a vibratory plate from natural pulp, it is preferable to raise the beating degree of the pulp as much as possible for increasing the value of $\sqrt{E/\rho}$. However, on the other hand, when the beating degree is excessively great, the internal loss becomes too small to be desirable. Thus, there are two mutually opposing limitations. Accordingly, it has heretofore been normal to determine the beating degree so as to harmonize these limitations. For these reasons, the beating degree of pulp for a vibratory plate has heretofore provided a freeness of about 350 – 600 cc. only.

It is possible experimentally to test a natural pulp having a high beating degree. However, pulp having a high beating degree is not used commercially because it drains so poorly that it is difficult to make paper from such pulp, production is costly and its efficiency is poor.

The present invention is characterized by combining pulp having a beating degree of not higher than about 300 cc. of freeness, with carbon fibers having a Young's modulus of at least about 8000 kg/mm².

The present invention makes it possible efficiently to obtain a vibratory plate having a large value of $\sqrt{E/\rho}$ and a proper internal loss.

As mentioned above, natural pulp having a high beating degree is characterized by internal fibrillation of fibers, external fibrillation of fibers and formation of fine fibers. Such pulp functions very effectively as a binder for carbon fibers having a high Young's modulus. Especially, in the case of carbon fibers whose surfaces have been finely etched by an oxidation treatment, as by the method of U.S. Patent No. 3,476,703, for example, its effectiveness as an adhesive becomes very great.

Figure 3:
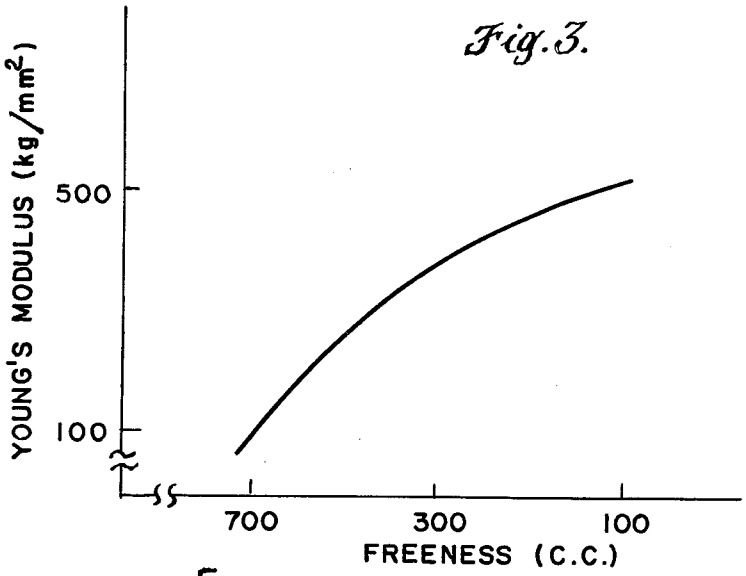
FIG. 3 is a graph showing the relationship between the Young's modulus of paper made from pulp mixed with 30% by weight of carbon fiber and the beating degree (freeness) of said pulp.

FIG. 3 shows the relationship between the Young's modulus of paper made from natural pulp containing 30% by weight of carbon fibers having a Young's modulus of 20,000 kg/mm² and the beating degree of the natural pulp that was used. FIG. 3 shows that, as the beating degree of the natural pulp increases (freeness decreases), the Young's modulus of the paper increases, which shows that natural pulp having a high beating degree works efficiently as a binder. It has been found that particularly pulp having a high beating degree of not higher than 300 cc. of freeness is effective.

Figure 4:
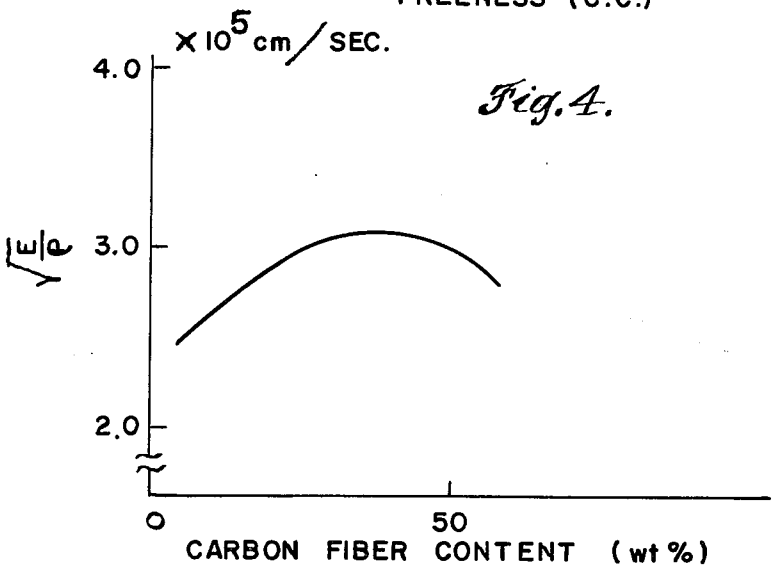
FIG. 4 is a graph showing the relation between the $E/\rho$ of paper made from pulp having a high beating degree mixed with carbon fibers, and the mix ratio of the carbon fibers.

FIG. 4 shows the relationship between the value of $\sqrt{E/\rho}$ of paper made from a mixture of natural pulp having a high beating degree of 100 cc. of freeness and carbon fibers having a Young's modulus of 20,000 kg/mm², illustrating the effect of various percentages of carbon fibers, and the content of carbon fibers. It is understood that since the natural pulp having a high beating degree works effectively as a binder, as the content of the carbon fibers increases, $\sqrt{E/\rho}$ increases by which the paper has a value of $\sqrt{E/\rho}$ which is greater than a conventional vibratory plate can have.

When the content of carbon fibers exceeds about 50% by weight, the $\sqrt{E/\rho}$ decreases. This is considered to be due to the fact that the amount of natural pulp having a high beating degree decreases as compared with the amount of carbon fibers having a high Young's modulus and therefore, its adhering or binding effect decreases.

Since pulp having a high beating degree is a fine fibrous material, the internal loss of such pulp per se is great, as compared with those of conventional binders of the resin or rubber series. Accordingly, such pulp is effective as a binder and further the internal loss of paper made from a mixture of such pulp and carbon fibers has sufficient value as a vibratory plate for an audio-electrical instrument. Specifically, by the use of pulp having a high beating degree, a vibratory plate for an audio electrical instrument is obtained which has a high value of $\sqrt{E/\rho}$ and also has a large internal loss, which has not heretofore been available using conventional adhesives of the resin or rubber series.

The internal loss of paper, which has been made of pulp having a high beating degree mixed with carbon fibers, increases as compared with that of paper made only of such pulp and containing no carbon fibers. Accordingly, natural pulp having a high beating degree of not higher than 300 cc. of freeness, which has not been usable as pulp alone, has become available for use as a material for a paper vibratory plate for an audio-electrical instrument for the first time, by mixing with carbon fibers.

Figure 5:
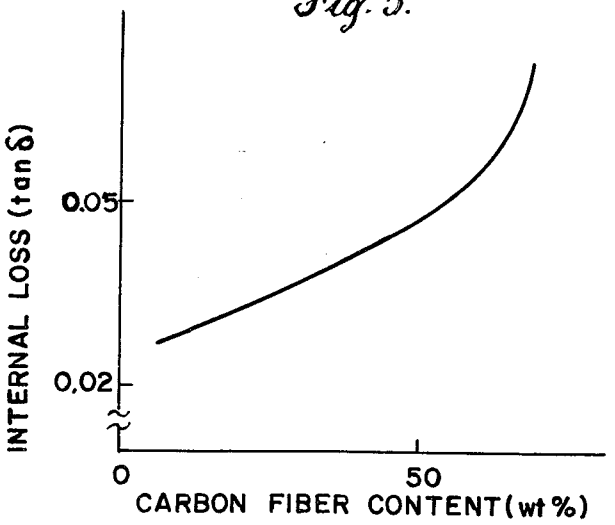
FIG. 5 is a graph showing the relationship between the internal loss of paper made from pulp having a high beating degree mixed with carbon fibers and the mix ratio of the carbon fibers.

FIG. 5 represents one such example, showing that the internal loss of paper whose main component is natural pulp having a high beating degree of about 100 cc. of freeness increases by mixing carbon fibers having a Young's modulus of 20,000 kg/mm$^2$ with such pulp. For example, by mixing 10 – 30% by weight of carbon fibers with such pulp, the resulting paper has an internal loss which is the same as or better than the internal loss of paper made only from natural pulp having a low beating degree of substantially 400 – 600 cc. of freeness.

Further, by mixing carbon fibers with pulp having a high beating degree, the drainage of such pulp is improved. Accordingly, natural pulp having a high beating degree which has heretofore been unavailable for use alone, due to poor drainage, is usable for making paper according to the present invention.

Figure 6:
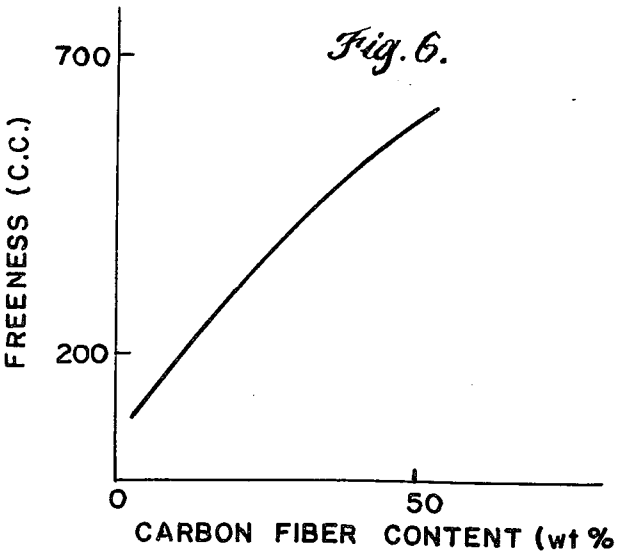
FIG. 6 is a graph showing the relationship between the freeness of the mixture of pulp having a high beating degree and carbon fibers and the mix ratio of the carbon fibers.

FIG. 6 shows that by mixing carbon fibers having a Young's modulus of 20,000 kg/mm$^2$ with natural pulp having a high beating degree, the drainage of paper made from such mixture is improved (its freeness increases). FIG. 6 shows that mixed fibers obtained by mixing 20 – 30% by weight of carbon fibers with natural pulp having a high beating degree of 80 – 90 cc. of freeness has the same good drainage as that of natural pulp having a substantially low beating degree of 300 – 450 cc.

It will be observed, accordingly, that the percentage of carbon fibers may range from about 3% to about 75% by weight, preferably about 4% to about 50% by weight, and still more preferably about 5% to about 35% by weight according to this invention.

Another advantage gained by mixing carbon fibers having a high Young's modulus with natural pulp having a high beating degree is that, strains or stresses are not caused in the drying step after molding the vibratory plate into a cone or dome. Usually, when a vibratory plate, composed only of paper made from natural pulp having a high beating degree, is dried by heating after molding, stresses or strains are present in the shape of the vibratory plate, which makes the subsequent pressing operation difficult. This trend becomes aggravated as the beating degree of the natural pulp increases. In the case of this invention, the subsequent pressing step is facilitated and may even be omitted in some cases.

According to this invention, the pulp functions as an effective binder for the carbon fibers and to reduce the decrease of the internal loss. On the other hand, the carbon fibers function to increase the internal loss and the apparent freeness and to improve the drainage of the natural pulp.

According to the present invention, it is possible to obtain a vibratory plate having a large value of $\sqrt{E/\rho}$ and a suitable internal loss. This combination has not been attainable with the use of conventional methods.

Although the carbon fibers and natural pulp having a high beating degree used in the present invention may be selected from known materials, vibratory plates made by using either one of these materials alone is entirely unsatisfactory for use as vibratory plate for an audio-electrical instrument. By combining the two as in the present invention, it is possible for the first time to make up for the mutual drawbacks of the individual components and obtain an excellent product having unprecedented characteristics as a vibratory plate for an audio-electrical instrument, as compared to conventional vibratory plates.

According to the present invention, it is possible to provide a vibratory plate having a suitable internal loss and a value of $\sqrt{E/\rho}$ which is very large in comparison to conventional vibratory plates. Accordingly, considering a cone made of the combination of this invention, even when the vertical angle 2 $\theta$ of the cone, the radius a of the cone, the mass mc of the cone and the mass mv of the voice coil are the same, the value of $\sqrt{E/\rho}$ is large and it is accordingly possible to increase the value of fh in that proportion. Even in a large diameter speaker, it is possible to generate evenly a high frequency sound zone of 10,000 – 20,000 Hz with excellent fidelity, which cannot be accomplished by a conventional speaker. Generation of a low frequency sound zone is made possible by adopting the well-known free edge construction made of soft leather, cotton cloth or synthetic rubber to the edge of the conic vibratory plate.

Figure 8:
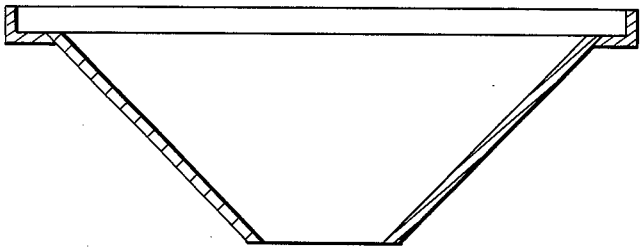
FIG. 8 shows a vibratory plate shaped as a cone.
Figure 9:
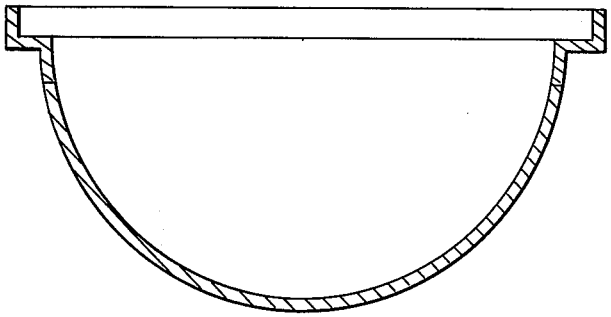
FIG. 9 shows a vibratory plate shaped as a dome.
Figure 10:
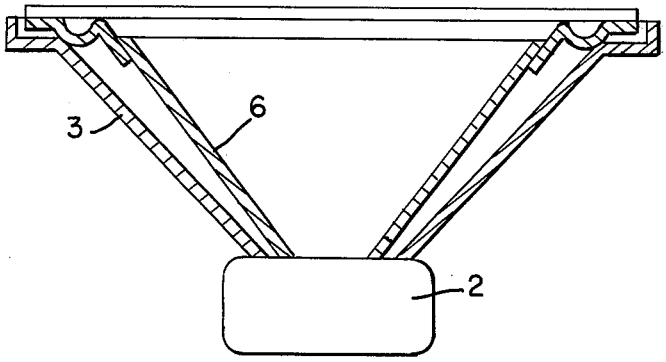
FIG. 10 shows a high fidelity speaker having a sound reproducing element in the form of a vibratory plate according to this invention.

Although we have heretofore referred to the shape of the vibratory plate as a cone, other shapes such as domes, etc., may also be used as shown in FIGS. 8 and 9. The high fidelity speaker may have a frame 3, a shaped speaker vibratory element 6, and magnetic means supported by yoke 2 for vibrating said element 6 to convert electrical impulses to audio responses, as described in the patent to Shiga et al No. 3,717,218 and as shown in FIG. 10 of the drawings.

As mentioned above, according to the present invention, it is possible to generate evenly a frequency from a low value of 30 – 50 Hz to a high value of 15,000 – 20,000 Hz which has heretofore been virtually impossible when using only one vibratory plate. Moreover, since the vibratory plate according to the present invention has a suitable internal loss, it is possible to regenerate a sharper sound having excellent quality of separation of sounds and having an outstanding transient response. Further, the present invention enhances productivity and reduces the incidence of below-standard products in the production of vibratory plates.

The following example is illustrative of the invention:

To 22 grams of material pulp, enough water was added to make the weight of the mixture 150 grams. The pulp was beaten in a beating machine until a Canadian standard of freeness of 100 cc. was attained. The resulting pulp was mixed with 6 grams of surface-treated (oxidized) carbon fibers having a diameter of 8 $\mu$ and a length of 5 mm (density 1.73, Young's modulus 20,000 kg/mm$^2$) and the two were mixed for 1 – 2 minutes in a mixer. The resulting mixture was processed in a paper-making machine to make a paper cone having a diameter of 20 cm and an absolute dry weight of about 2.1 grams. The paper cone was lightly dehydrated and pressed into the shape of a cone having a density (after drying) of 0.35 – 0.40 gr/cm$^3$. The resulting paper cone had an edge of cotton cloth adhered to it to make a free edge-style vibratory plate.

Figure 7:
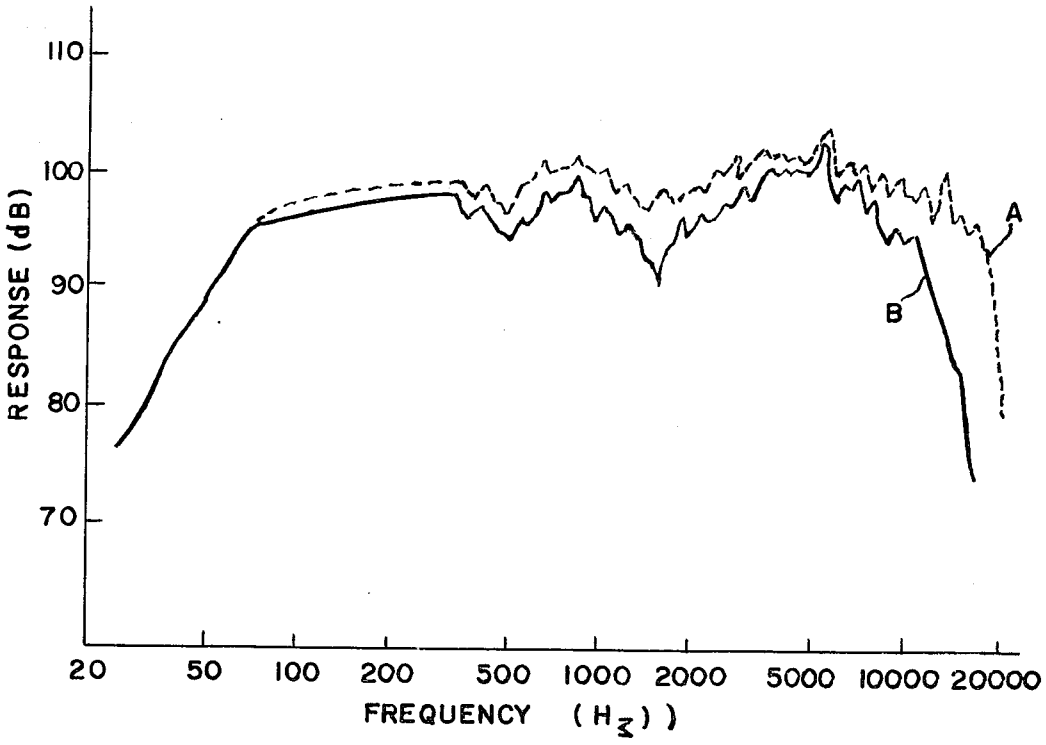
FIG. 7 is a graph showing the relationship between the frequency and the response of an audio-electric speaker using a vibratory plate according to the present invention and an audio-electric speaker using a conventional vibratory plate.

Next, using the same method, a cone-shaped paper vibratory plate having a weight of about 3.4 grams was made of natural pulp only, without containing carbon fibers. These two paper vibratory plates were incorporated into otherwise identical speakers, and the frequency characteristics of the speakers were measured. The results are shown in FIG. 7. Curve A in FIG. 7 corresponds to the speaker having a paper-carbon vibratory plate according to the present invention and curve B in FIG. 7 was obtained from the speaker having a paper vibratory plate made of pulp without carbon fibers. As will be apparent from these curves, the vibratory plate according to the present invention has excellent properties in generating high frequency sound.

What is claimed is:

1. A vibratory plate comprising a substantially uniform mixture of paper pulp having a maximum beating degree of about 300 cc. of Canadian standard freeness and carbon fibers having a Young's modulus of at least about 8000 kg/mm$^2$.

2. The vibratory plate defined in claim 1, wherein the weight percentage of carbon fibers, based upon total weight of carbon fibers plus pulp, is in the range of about 3% to about 75%.

3. The vibratory plate defined in claim 1, wherein said percentage is about 4 – 50.

4. The vibratory plate defined in claim 1, wherein said percentage is about 5 – 35.

5. A vibratory plate according to claim 2 for an audio electrical instrument, wherein said carbon fibers have a Young's modulus of at least about 15,000 kg/mm$^2$.

6. The vibratory plate according to claim 2, wherein said carbon fibers have an average diameter of about 1to 20 $\mu$.

7. The vibratory plate according to claim 2, wherein said carbon fibers have an average length of about 0.5 to 20 mm.

8. The vibratory plate according to claim 2, wherein said carbon fibers have a roughened surface.

9. The vibratory plate defined in claim 2, wherein said surface is oxidized.

10. The vibratory plate according to claim 2, wherein said vibratory plate is shaped as a cone.

11. The vibratory plate according to claim 2, wherein said vibratory plate is shaped as a dome.

12. A high fidelity speaker sound reproducing element comprising a shaped vibratory plate consisting essentially of a. about 25% to about 97% by weight of paper pulp having a maximum beating degree of about 300 cc. of Canadian standard freeness, and b. about 3% to about 75% by weight of carbon fibers having a minimum Young's modulus of about 8000 kg/mm$^2$.

13. The element defined in claim 12, wherein the carbon fibers have an average filament diameter of about 1 – 20 microns and an average filament length of about 5 – 20 millimeters, and wherein said Young's modulus is in the range of about 8000 to about 50,000 Kg/mm$^2$.

14. A high fidelity speaker having a frame, a shaped speaker vibratory element, and a magnetic means for vibrating said element to convert electrical impulses to audio responses, said element comprising the element of claim 12.

* * * * *